US007441872B2

(12) United States Patent
Ito et al.

(10) Patent No.: US 7,441,872 B2
(45) Date of Patent: Oct. 28, 2008

(54) IMAGE FORMING DEVICE WITH HOLDER FOR DETACHABLY MOUNTING INK CARTRIDGE THEREON

(75) Inventors: Shingo Ito, Kasugai (JP); Noritsugu Ito, Tokoname (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 279 days.

(21) Appl. No.: 11/276,726

(22) Filed: Mar. 10, 2006

(65) Prior Publication Data

US 2006/0203049 A1 Sep. 14, 2006

(30) Foreign Application Priority Data

Mar. 10, 2005 (JP) ..... 2005-067911

(51) Int. Cl.
*B41J 2/14* (2006.01)
*B41J 2/175* (2006.01)

(52) U.S. Cl. ..... 347/49; 347/85

(58) Field of Classification Search ..... 347/49, 347/84, 85; 141/2, 18
See application file for complete search history.

(56) References Cited

U.S. PATENT DOCUMENTS

| | | | | |
|---|---|---|---|---|
| 4,709,249 | A * | 11/1987 | Hanagata | 347/85 |
| 5,119,115 | A * | 6/1992 | Buat et al. | 347/86 |
| 5,359,357 | A * | 10/1994 | Takagi et al. | 347/49 |
| 5,905,518 | A * | 5/1999 | DeFilippis | 347/85 |
| 6,422,674 | B1 * | 7/2002 | Hinami et al. | 347/7 |
| 6,582,068 | B2 * | 6/2003 | Ishizawa et al. | 347/85 |
| 6,702,433 | B2 * | 3/2004 | Kono | 347/85 |
| 7,178,909 | B2 * | 2/2007 | Yoshiyama et al. | 347/86 |
| 7,252,374 | B2 * | 8/2007 | Usui et al. | 347/84 |
| 2004/0223036 | A1 | 11/2004 | Inoue | |

FOREIGN PATENT DOCUMENTS

| | | |
|---|---|---|
| JP | H5 35284 | 5/1993 |
| JP | H5 85639 | 11/1993 |
| JP | H6 15837 | 1/1994 |
| JP | H8 90783 | 4/1996 |
| JP | 19972550139 | 6/1997 |
| JP | 19982804684 | 7/1998 |
| JP | 2003311999 | 11/2003 |
| JP | 2003312000 | 11/2003 |

OTHER PUBLICATIONS

European Patent Appl'n No. 06 25 1282 (counterpart of U.S. Appl. No. 11/276,726), Extended European Search Report, dated Jun. 15, 2006.

* cited by examiner

*Primary Examiner*—Anh T. N. Vo
(74) *Attorney, Agent, or Firm*—Baker Botts L.L.P.

(57) ABSTRACT

To prevent leakage of ink in an ink tank from an air inflow port formed in an ink cartridge, an accommodating section in which an ink absorbing member is disposed is provided outside the ink cartridge so that the ink absorbing member opposes the air inflow port of the ink cartridge. The accommodating section is fluidly connected to the air inflow port of the ink cartridge and formed with an atmosphere communication hole in communication with atmosphere. Thus, ink leaked out through the air inflow port can be absorbed by the ink absorbing member and air can be introduced into the ink tank for an amount corresponding to an amount of ink supplied to a recording head.

16 Claims, 17 Drawing Sheets

IMAGE FORMING DEVICE WITH HOLDER FOR DETACHABLY MOUNTING INK CARTRIDGE THEREON

CROSS REFERENCE TO RELATED APPLICATION

This application claims a priority to Japanese Patent Application No. 2005-067911 filed on Mar. 10, 2005, the contents of which are hereby incorporated by reference into the present application.

TECHNICAL FIELD

The invention relates generally to an image forming device, and more particularly to a structure of a holder on which an ink cartridge is detachably mounted.

BACKGROUND

A conventional ink cartridge for an inkjet printer is formed with an ink outflow port and an air inflow port. Ink stored in an ink tank is supplied to a recording head via the ink outflow port. Internal space of the ink tank is in communication with atmosphere via the air inflow port. With this structure, pressure difference between interior and exterior of the ink tank is substantially eliminated by introducing air into the ink tank for an amount corresponding to an amount of ink supplied to the recording head.

Japanese Utility Model Publication No. HEI-5-35284 discloses a structure for detachably mounting the above-described ink cartridge on a holder from which a pair of hollow needles projects upward. The hollow needles penetrate into a rubber plug provided at the bottom of the ink tank when the ink cartridge is mounted on such a holder. One of the hollow needles is used as the ink outflow port and the other as the air inflow port.

However, ink stored in the ink tank may leak out through the air inflow port as the latter is in communication with atmosphere. In order to prevent the leakage of the ink, an air intake tube is vertically provided internally of the ink tank so that the lower end of the air intake tube is connected to the air inflow port and the upper opening of the air intake tube is positioned above the surface of the ink in the ink tank. Further, a hydrophobic filter is attached to the upper opening of the air intake tube to block ink flow thereinto.

When troubled inkjet printers are sent to the service center for repair or defective inkjet printers are sent back to the manufacturer, the inkjet printers with the ink cartridge need to be transported. During transportation, it is impossible to hold the printers in a normal use orientation, so the ink cartridge slanted from the vertically oriented normal position causes the top opening of the air intake tube to immerse into the ink. In such a case, the hydrophobic filter attached to the top opening of the air intake tube prevents the ink from leaking out with the ink cartridge disclosed in Japanese Utility Model Publication No. HEI-5-35284.

However, during transportation which may be land transportation, water transportation, or air cargo transportation, temperature and atmospheric pressure in the environment of the cargo may abruptly change. When the pressure in the ink tank increases with the top opening of the air intake tube immersed in the ink, ink can ooze out from the hydrophobic filter. The ink thus leaked out from the air intake port stains the inkjet printer.

Japanese Patent Application Publication No. HEI-8-90783 also discloses an ink tank for an inkjet printer. In the inkjet printer disclosed therein, pressure change in the interior of the ink tank does not cause ink to leak out through an air inflow port. To attain the goal, an ink absorbing member is disposed within the ink tank and a rib is formed in the portion close to the air inflow port in order to prevent the ink absorbing member from directly contacting the air inflow port.

However, the ink tank provided with the ink absorbing member and the rib increases the cost of ink cartridge.

SUMMARY

In order to solve the above-described problems, it is an object of the invention to prevent an image forming device from being stained by ink leaked out from an air intake port of an ink cartridge without increasing the cost of the ink cartridge.

To achieve the above and other objects, there is provided an image forming device that includes a housing, a recording head, an ink cartridge, a holder, an ink supply tube, an ink absorbing member, and an accommodating section. The ink cartridge includes an ink tank in which ink is stored. The wall of the ink cartridge is formed with an ink outflow port from which ink from the ink tank is discharged and an air inflow port that brings an internal space of the ink tank in communication with atmosphere. The holder has a wall on which the ink cartridge is detachably mounted. The holder is placed on the wall of the housing. The ink supply tube supplies ink in the ink tank via the ink outflow port to the recording head for image recordation while introducing air into the ink tank for an amount corresponding to an amount of ink supplied to the recording head. The accommodating section is disposed outside the ink cartridge and has an inner space in which the ink absorbing member is accommodated. The accommodating section is formed with an atmosphere communication hole in communication with atmosphere.

According to another aspect of the invention, the absorbing member disposed within the accommodating section is opposed to the air inflow port.

With the image forming device thus constructed, ink absorbing member accommodated in the accommodating section absorbs ink leaked out from the ink tank through the air inflow port.

BRIEF DESCRIPTION OF THE DRAWINGS

The particular features and advantages of the invention as well as other objects will become apparent from the following description taken in connection with the accompanying drawings, in which.

DETAILED DESCRIPTION

Specific illustrative examples of the invention will be described below with reference to FIGS. 1 through 17C.

Figure 1:
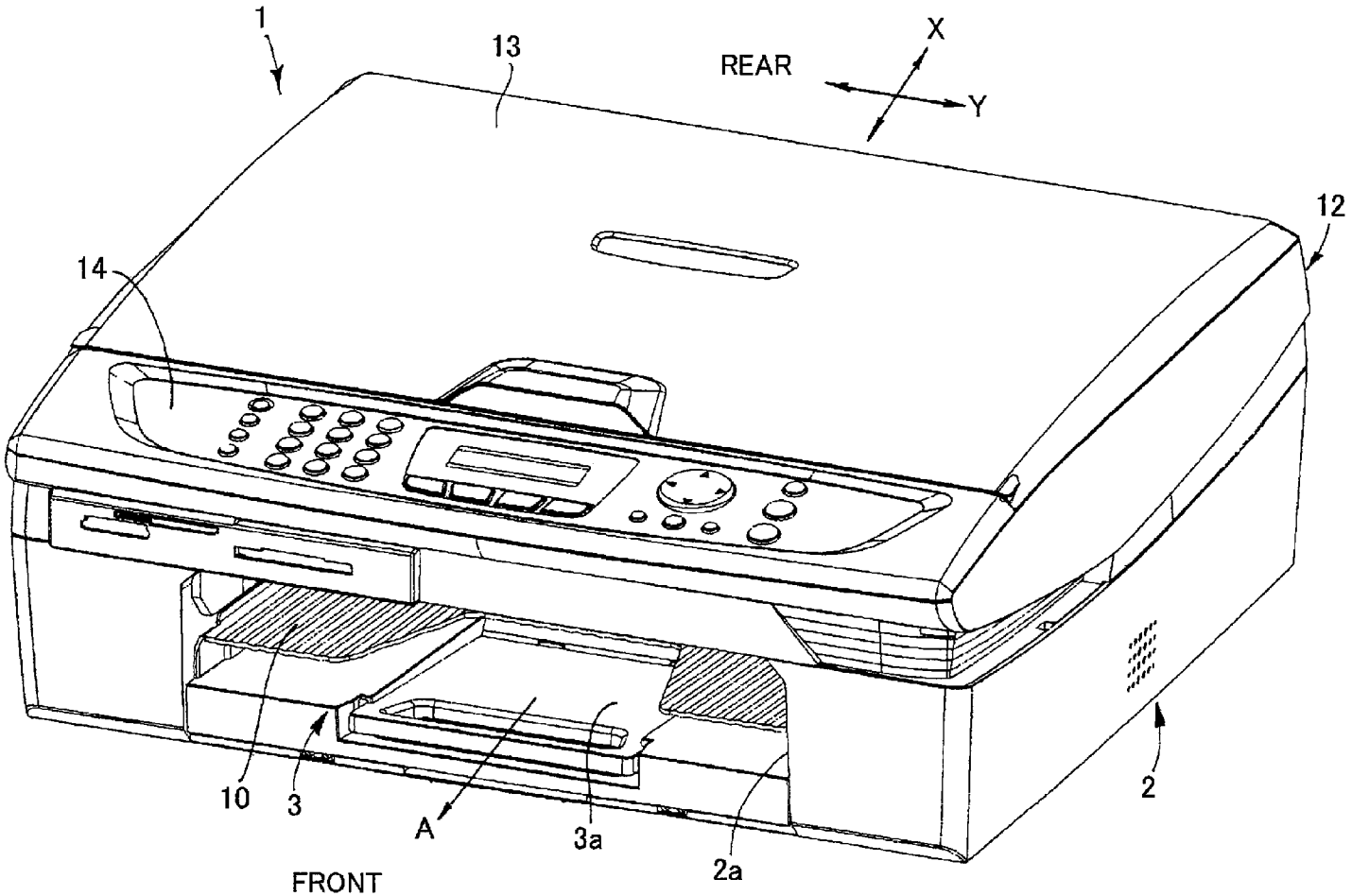
FIG. 1 is a perspective view showing an image forming device in accordance with an embodiment of the invention.

An image forming device 1 according to an illustrative example of the invention, to which the invention is applied, is a multifunction device (MFD) having a printing function, copying function, scanning function and facsimile transmitting/receiving function. As shown in FIG. 1, the device includes a body or housing 2 made from a synthetic resin. The housing 2 has a bottom wall on which a sheet feeding cassette 3 is slidably movably disposed. The sheet feeding cassette 3 can be inserted into the housing 2 from an opening 2*a* formed in the front side of the housing 2.

In this illustrative example, the sheet feeding cassette 3 can stack a plurality of recording media of different sizes cut to A4 size, letter size, legal size, postcard size. The sheet feeding cassette 3 stacks a plurality of cut sheets in such an orientation that the short-side of the sheet is in coincidence with the main scanning direction or Y-axis direction which is perpendicular to the sheet feeding direction (auxiliary scanning direction or X-axis direction).

Figure 2:
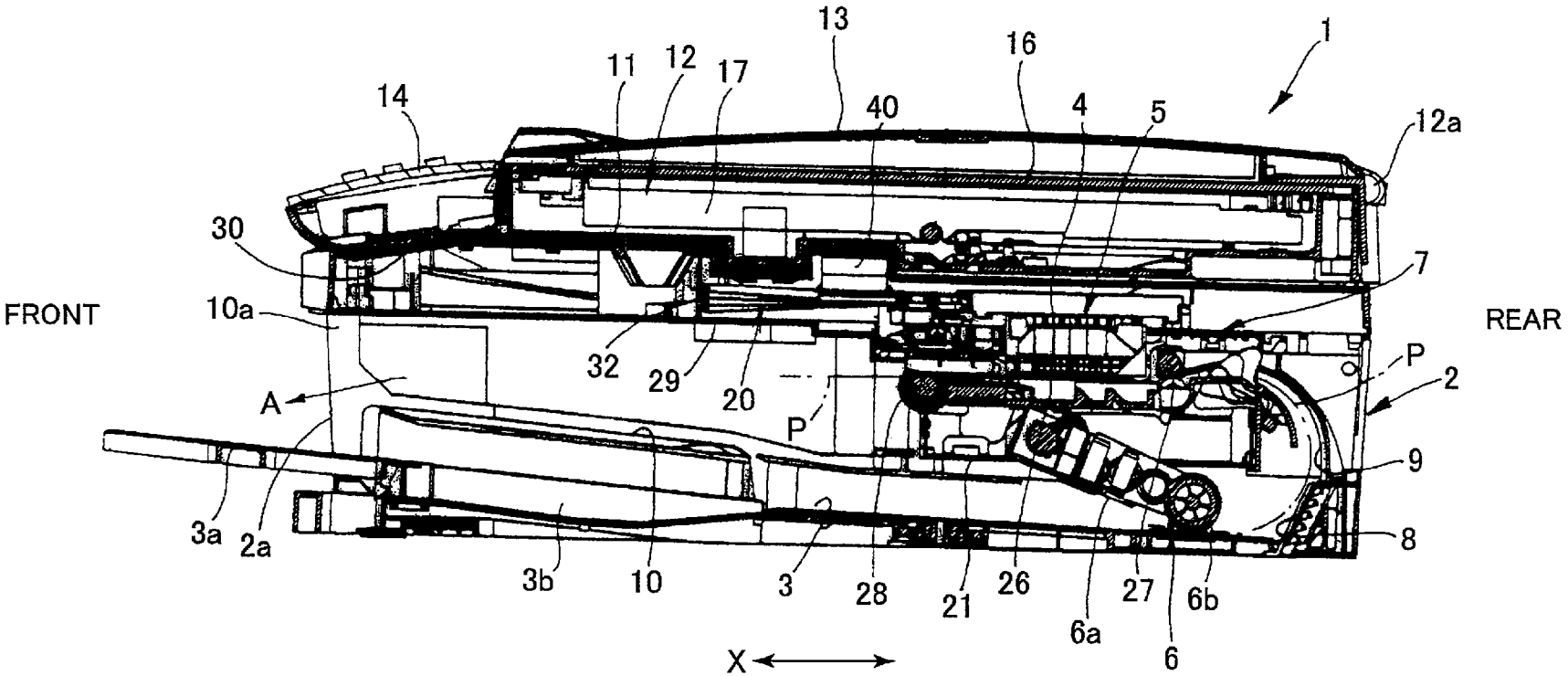
FIG. 2 is a side sectional view showing the image forming device in FIG. 1.

An auxiliary support member 3*a* is attached to the front portion of the sheet feeding cassette 3 to be slidably movable in the X-axis direction. The auxiliary support member 3*a* is provided for supporting the widthwise trailing edge of long-size paper, such as the legal size paper. FIG. 2 depicts the auxiliary support member 3*a* positioned outwardly from the body 2 of the image forming device 1. However, when sheet P is such a size that can be accommodated within the sheet feeding cassette 3, such as A4 size paper, the auxiliary support member 3*a* is unused and thus retracted to a retraction position 3*b* so as not to hinder the sheet feed operation.

An inclined separation block 8 is provided in the rearmost position (right side in FIG. 2) of the sheet feeding cassette 3 for separating sheets P. An arm 6*a* is attached to the housing 2 so that its upper portion is vertically movable. A sheet feed roller 6 is rotatably supported at the lower portion of the arm 6*a*. With the sheet feed roller 6 and the inclined separation block 8, sheets P stacked in the sheet feeding cassette 3 are separated and conveyed one by one toward a U-turn path 9 configured by a curved plate having a U-shaped cross-section and extending in the widthwise direction of sheet P. The sheet P is fed via the U-turn path 9 to a recoding unit 7 disposed rearwardly of and above the sheet feeding cassette 3. As will be described later, the recoding unit 7 includes a reciprocally movable carriage 5 on which an inkjet recording head 4 is mounted for recording images on the sheet P.

A discharge tray 10 is provided above the sheet feeding cassette 3. Sheets P that have been recorded in the recoding unit 7 are discharged onto the discharge tray 10 with the recorded surface face up. A discharge port 10*a* open toward the discharge tray 10 is formed in the front side of the housing 2.

An image reader 12 used when copying documents or transmitting facsimile messages is disposed above the housing 2. The image reader 12 has a bottom wall 11 disposed directly above an upper cover 30 of the housing 2. The image reader 12 is pivotally movable about a pivot shaft attached to one side edge of the housing 2 so that the top of the housing 2 is exposed or unexposed by the image reader 12. A document cover 13 is provided for covering the top surface of the image reader 12. A rear edge of the document cover 13 is attached to the rear edge of the image reader 12 by hinges 12*a* so that the document cover 13 can rotate about the hinges 12*a*.

As shown in FIG. 1, disposed on top of the housing 2 and in the front side of the image reader 12 is an operation panel 14 including a number of operation buttons and liquid crystal display panel. As viewed from the top of the image forming device 1, the recoding unit 7, the discharge tray 10 and an ink storage section 15 provided at one side of the discharge tray 10 fall into an area in which the image reader 12 and the operation panel 14 are disposed. In a state in which the auxiliary support member 3*a* is retracted to the retraction position 3*b*, the length of the sheet feeding cassette 3 in the X-axis direction is approximately equal to the total length of the image reader 12 and the operation panel 14 in the same direction. The image forming device 1 is a generally rectangular parallelepiped with a square top. Such a shape facilitates packing of the image forming device for the purpose of shipping. Further, the packing box can be compact in size.

The image reader 12 includes a glass plate 16 on which an original document is placed. To place the original document thereon, the document cover 13 is pivotally moved upward to expose the glass plate 16. An image scanner 17 using a contact image sensor (CIS) is disposed beneath the glass plate 1 for reading images on the original document. The image scanner 17 extends in the main scanning direction or X-axis direction in FIG. 2, and is reciprocally movable in the auxiliary scanning direction or Y-axis direction in FIGS. 3 through 5.

Figure 4:
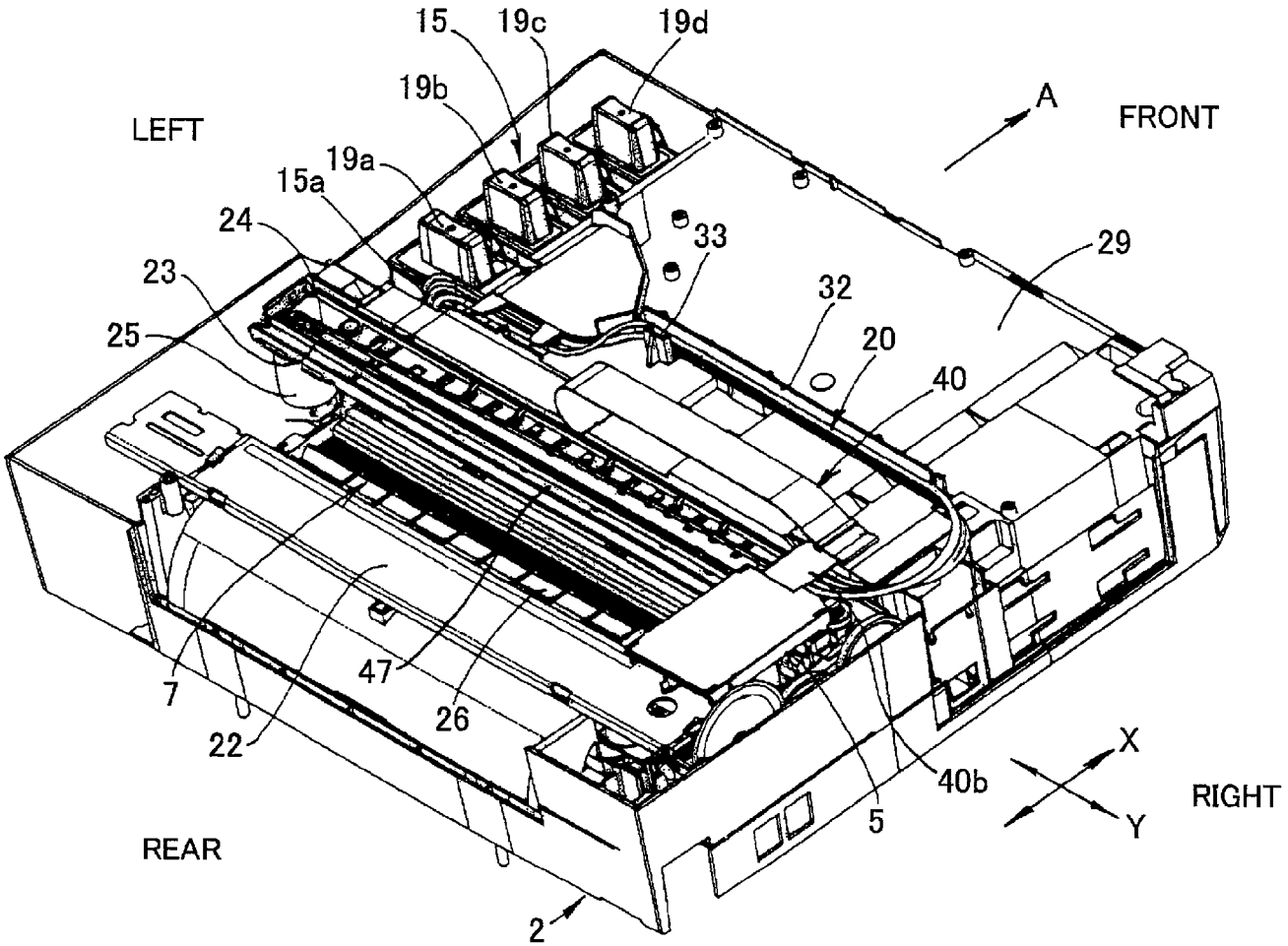
FIG. 4 is a perspective view showing the image forming device in FIG. 1 from which an upper cover is removed.
Figure 5:
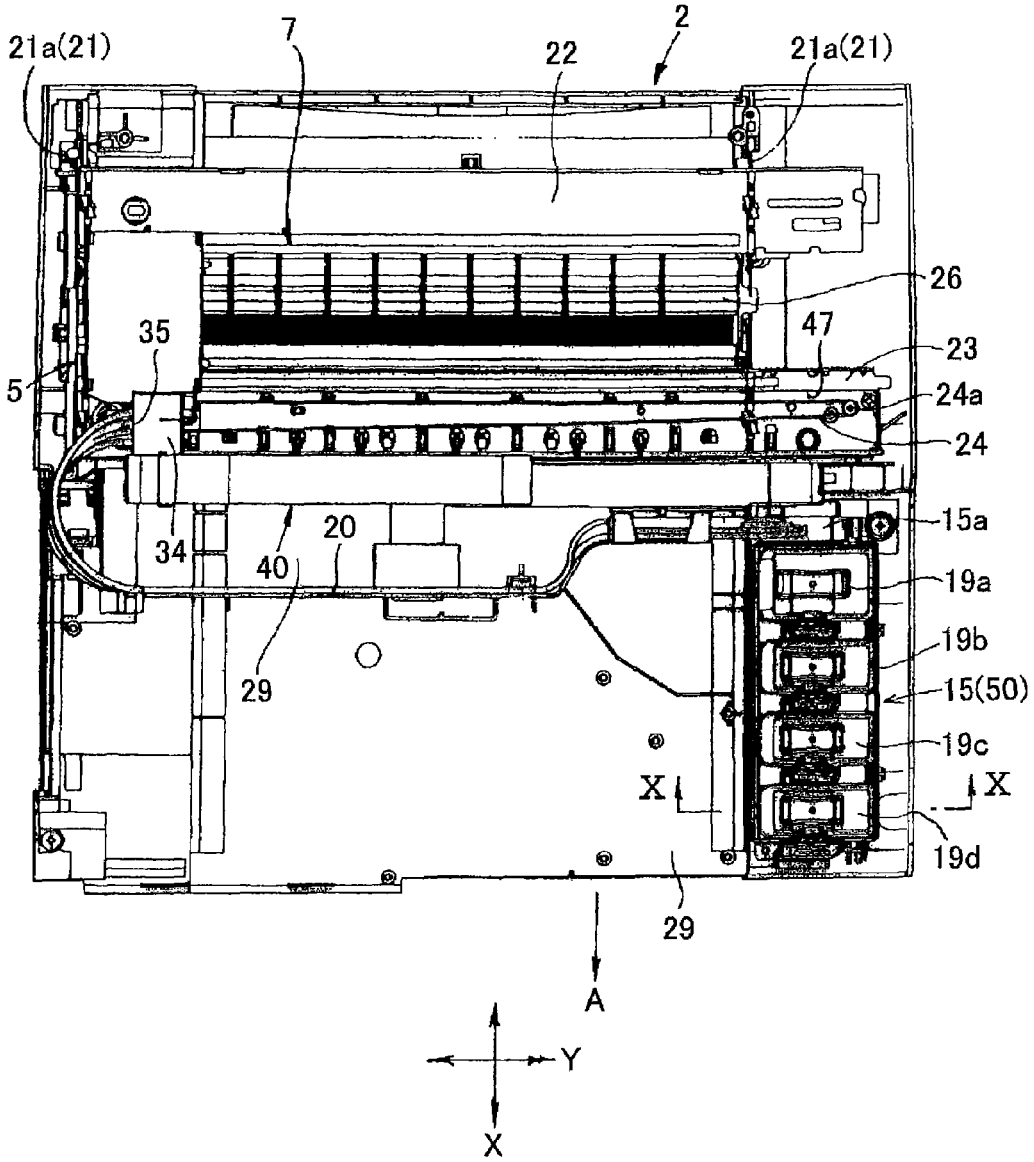
FIG. 5 is a plan view showing the image forming device shown in FIG. 4.

As best shown in FIG. 5, the recording unit 7 is supported on a pair of left and right side plates 21*a* of a main frame 21 made from metal. As shown in FIGS. 4 and 5, the recording unit 7 includes first and second guide members 22 and 23, a carriage 5, a timing belt 24, a carriage (CR) motor 25, a flat platen 26, and an encoder strip 47. The first and second guide members 22 and 23 are of an elongated, plate-like shape extending in the Y-axis direction (main scanning direction). Here, the first guide member 22 is positioned upstream of the second guide member 23 with respect to a sheet conveying direction (direction indicated by the arrow A).

The carriage 5 is supported on the first and second guide members 22 and 23 to be reciprocally slidably movable. The timing belt 24 is disposed on the top surface of the second guide member 23 to extend in parallel with the second guide member 23. The timing belt 24 is used to reciprocally move the carriage 5 on which the recording head 4 is mounted. To enable this reciprocal movement of the carriage 5, the carriage motor 25 drives the timing belt 24 via a pulley 24*a*. In this illustrative example, a DC motor is used as the carriage motor 25 but a stepping motor or other types of motors may be used in lieu thereof.

The flat platen 26 is disposed at the lower position of the recording head 4 and supports the sheets P being conveyed. The encoder strip 47 extends in the main scanning direction and detects the position of the carriage in the Y-axis direction (main scanning direction). The encoder strip 47 is an elongated, web-like member having a detection surface on which vertically extending slits are formed at an equi-pitch in the Y-axis direction.

A pair of registration rollers 27 is disposed upstream of the platen 26 in the sheet conveying direction to convey the sheet P to a position below the recording head 4. Furthermore, a sheet discharging roller 28 and an opposing spur roller (not shown) are disposed downstream of the platen 26 and driven to convey the sheet P that has passed through the recoding unit 7 to the discharge tray 10. The sheet discharging roller 28 is in contact with the back surface of the sheet P and the spur roller with the top surface of the sheet P.

An ink receiving portion (not shown) is disposed in a position away from one long-side of sheet P being conveyed and a maintenance unit (not shown) in a position away from another long-side of sheet P. Specifically, in FIG. 4, the ink receiving portion is disposed in a position near the rightside side plate 21*a* and the maintenance unit in a position near the leftside side plate 21*a*. During printing operation, the recording head 4 regularly performs ink flushing operation in order to prevent the nozzles from being clogged. Ink ejected through the flushing operation is received at the ink receiving portion. The maintenance unit wipes the surface of the nozzles on the recording head 4 while placing the carriage 5 in the standby position. Recovering operations are further performed to suck color ink from the individual ink cartridge in order to remove bubbles contained in a buffer tank (not shown) of the recording head 4.

Figure 3:
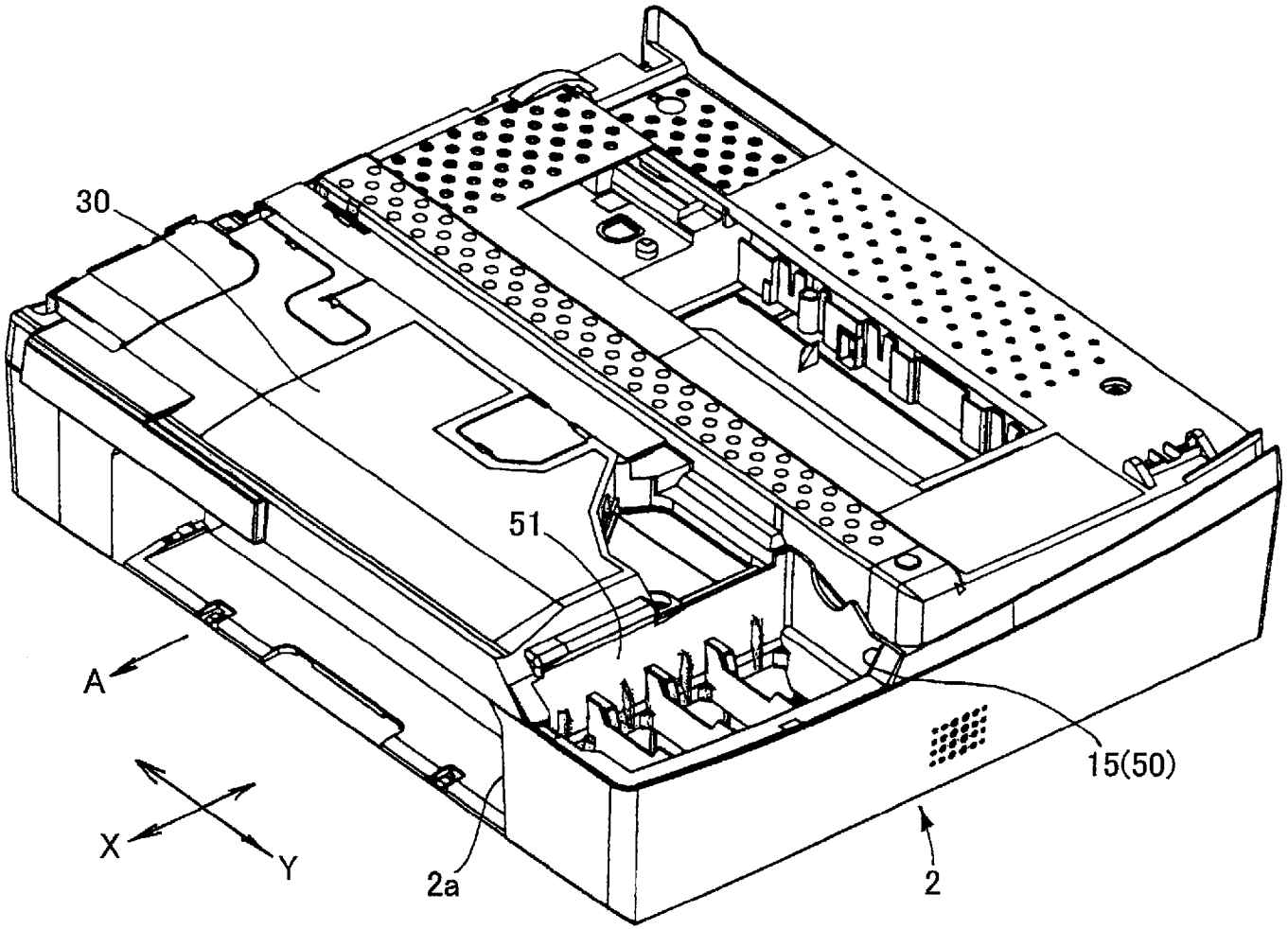
FIG. 3 is a perspective view showing the image forming device in FIG. 1 from which an image reading section is removed.

As shown in FIGS. 2 and 4, a metal lower cover 29 is positioned above the discharge tray 10 and extends from the lower surface of the second guide member 23 to the discharge port 10*a* at the front side of the housing 2. Further, as shown in FIGS. 2 and 3, an upper cover 30 is disposed above and spaced apart from the lower cover 29 and covers the carriage 5 and the reciprocal movement path of the carriage 5.

An ink storage section 15 (to be described later in detail) occupies a part of the housing 2. A box-shaped holder 50 with an open top is fixedly mounted on the recessed portion 2*b* (see FIG. 10) formed in the bottom wall of the housing 2. As shown in FIG. 3, the upper outer periphery of the holder 50 is surrounded by and fixed to a frame 51 attached to one side of the upper cover 30.

As will be described later, the holder 50 in the ink storage section 15 accommodates four color ink cartridges 19 for a full-color recordation. The four color ink cartridges 19 separately contain ink for the colors of black (Bk), cyan (C), magenta (M) and yellow (Y), and are designated by reference numerals 19*a*, 19*b*, 19*c*, and 19*d*, respectively, in FIGS. 4 through 6. Each of the ink cartridges 19 is of a box-shaped with a small-size rectangular top surface and a high height. The ink cartridges 19*a* through 19*d* are aligned in the X-axis direction and can be mounted on and dismounted from the holder 50 from the open top side.

An ink supply tube 20 is used to supply ink from each of the four ink cartridges 19 to the inkjet recording head 4. In the illustrative example, four ink supply tubes 20 are used. When a multiple colors of ink more than four, e.g., six, seven or eight colors of ink, is used for the full-color recordation, the corresponding number of color ink cartridges are accommodated in the ink storage section 15. Also, an increased number of ink supply tubes 20 is needed as the number of the ink cartridges 19 is increased. In the illustrative example shown in FIGS. 4 and 5, the ink supply tubes 20 are bundled at the exit 15*a* of the ink storage section 15 and extend to the carriage 5 where the ends of the ink supply tubes 20 are connected to the connection ports 35 formed in a connection piece 34 provided in the base of the carriage 5.

As best shown in FIG. 4, a flexible flat cable 40 is used to connect a controller (not shown) to the inkjet recording head 4 for transmitting various instruction signals generated from the controller to the recording head 4. The controller is mounted on the body 2 of the image forming device 1, and the inkjet recording head 4 on the carriage 5. In response to the instruction signals, ink droplets are selectively ejected from the nozzles. The flexible flat cable 40 is arranged in an area where the ink supply tubes 20 move in accordance with reciprocal movements of the carriage 5 in the Y-axis direction, i.e., main scanning direction, and extends substantially in parallel with the ink supply tubes 20. One end 40*b* of the flexible flat cable 40 is connected to the connection piece 34 formed on the carriage 5.

Figure 10:
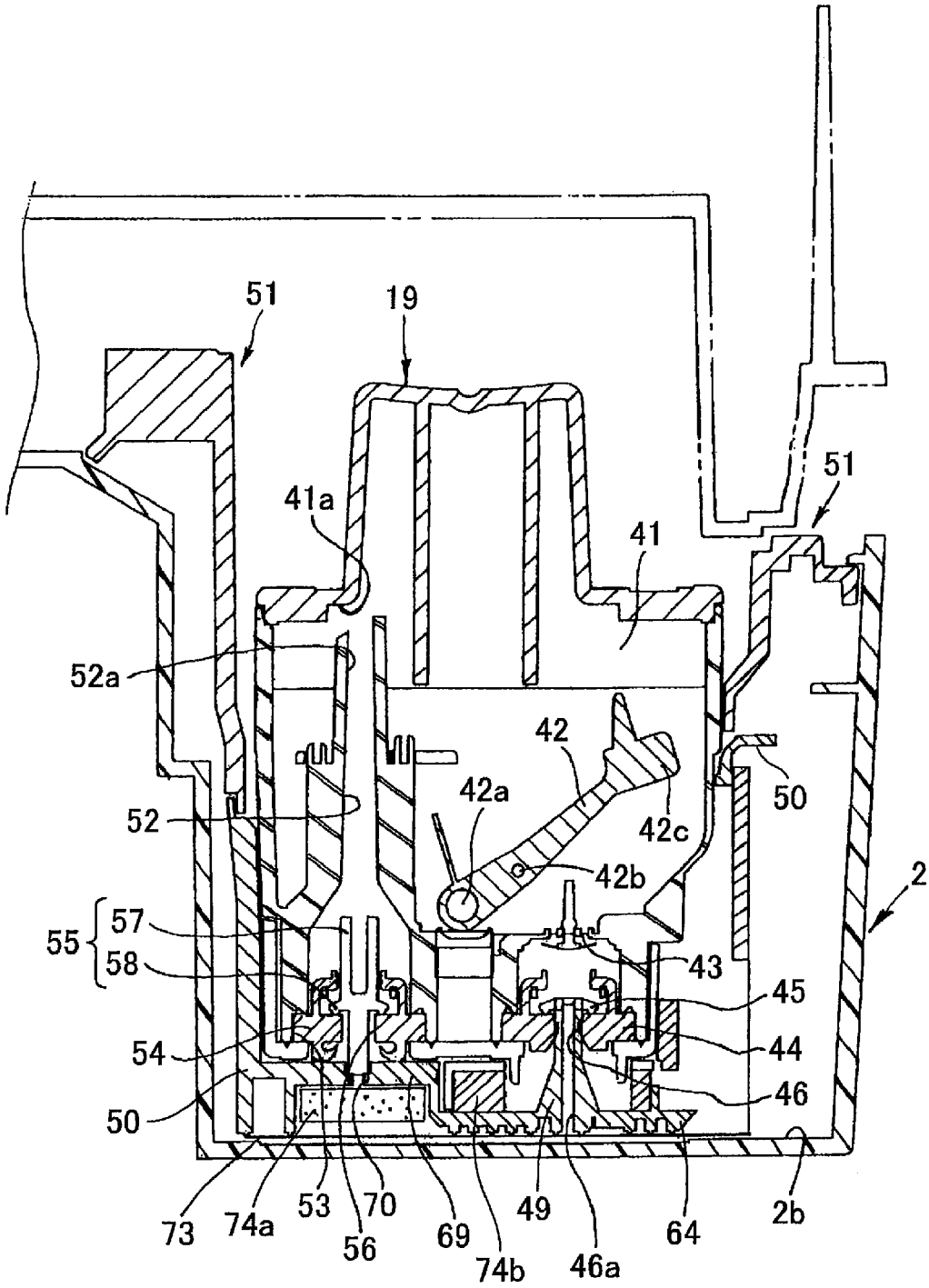
FIG. 10 is a cross-sectional view showing the image forming device, taken along a line X-X in FIG. 5.

Next, the ink cartridge 19 will be described. Each ink cartridge 19 has a box-shaped ink tank 41 for storing ink therein. As shown in FIG. 10, a light-shielding member 42 is disposed in the ink tank 41 for detecting a residual amount ink in the ink tank 41. The light-shielding member 42 includes a floating member 42*a*, a rotational shaft 42*b*, and a light-shielding plate 42*c*. The rotational shaft 42*b* is provided substantially in the central position in the longitudinal direction of the light-shielding member 42 and is rotatably supported by a support (not shown). The light-shielding member 42 has two end portions to which the floating member 42*a* and the light-shielding plate 42*c* are attached. The floating member

42*a* is a hollow, hermetically sealed cylinder confining air therein. The light-shielding plate 42*c* is a rectangular, plate-shaped member and detects the residual amount of ink in the ink tank 41 while cooperating with an optical sensor (not shown) provided in the holder 50.

More specifically, the light-shielding member 42 is rotatable about the rotational shaft 42*a*. The floating member 42*a* moves substantially vertically depending upon the residual amount of ink or the level of ink in the ink tank 41, so that the light-shielding member 42 changes its posture. The light-shielding plate 42*c* attached to one end of the light-shielding member 42 is detected by the optical sensor disposed in the holder 50. In this manner, the residual amount of ink in the ink cartridge 19 can be detected. Note that the light-shielding member 42 depicted in FIG. 10 is in such a position where ink is empty in the ink cartridge 19.

The ink cartridge 19 has a bottom wall formed with an ink supply port 43 in fluid communication with the ink tank 41, and an air tower 52 arranged aside the ink supply port 43. The ink supply port 43 is open downward and a packing member 44 having a normally-closed first valve 45 is disposed internally of the downwardly open space. The packing member 44 is formed at the central position with an ink outflow port 46 normally closed by the first valve 45. An ink discharge member 49 (to be described later) is inserted into the ink outflow port 46 from the lower side.

The air tower 52 is a sleeve-shaped member extending vertically within the ink tank 41. The upper end of the air tower 52 is in confrontation with a ceiling wall 41*a* of the ink tank 41. The air tower 52 is set so that its upper end opening 52*a* is at a position higher than the initial ink level surface of unused ink cartridge. Accordingly, as far as the posture of the ink cartridge 19 is held vertically, the ink in the ink tank 41 does not enter into the internal space of the air tower 52 from the upper end opening 52*a*.

A lower opening 53 is formed at the lower portion of the air tower 52. The lower opening 53 has an inner diameter that is relatively large as compared with the inner diameters of other parts of the air tower 52. An air packing member 54 having a normally-closed second valve 55 is disposed internally of the air tower 52. The second valve 55 includes a bar-shaped member 57 that vertically penetrates into an air inflow port 56 formed centrally of the air packing member 54. A sealing edge 58 is formed in the outer periphery of the bar-shaped member 57 so as to be in intimate contact with the upper surface of the air packing member 54, thereby hermetically sealing the air inflow port 56 and the lower opening 53.

A cylindrical lip is formed in the lower surface of the air packing member 54 to surround the lower end of the second valve 55. FIG. 10 indicates a state before the ink cartridge 19 is mounted on the holder 50, in which the lower portion of the bar-shaped member 57 protrudes outwardly from the lower wall of the ink cartridge 19.

Figure 6:
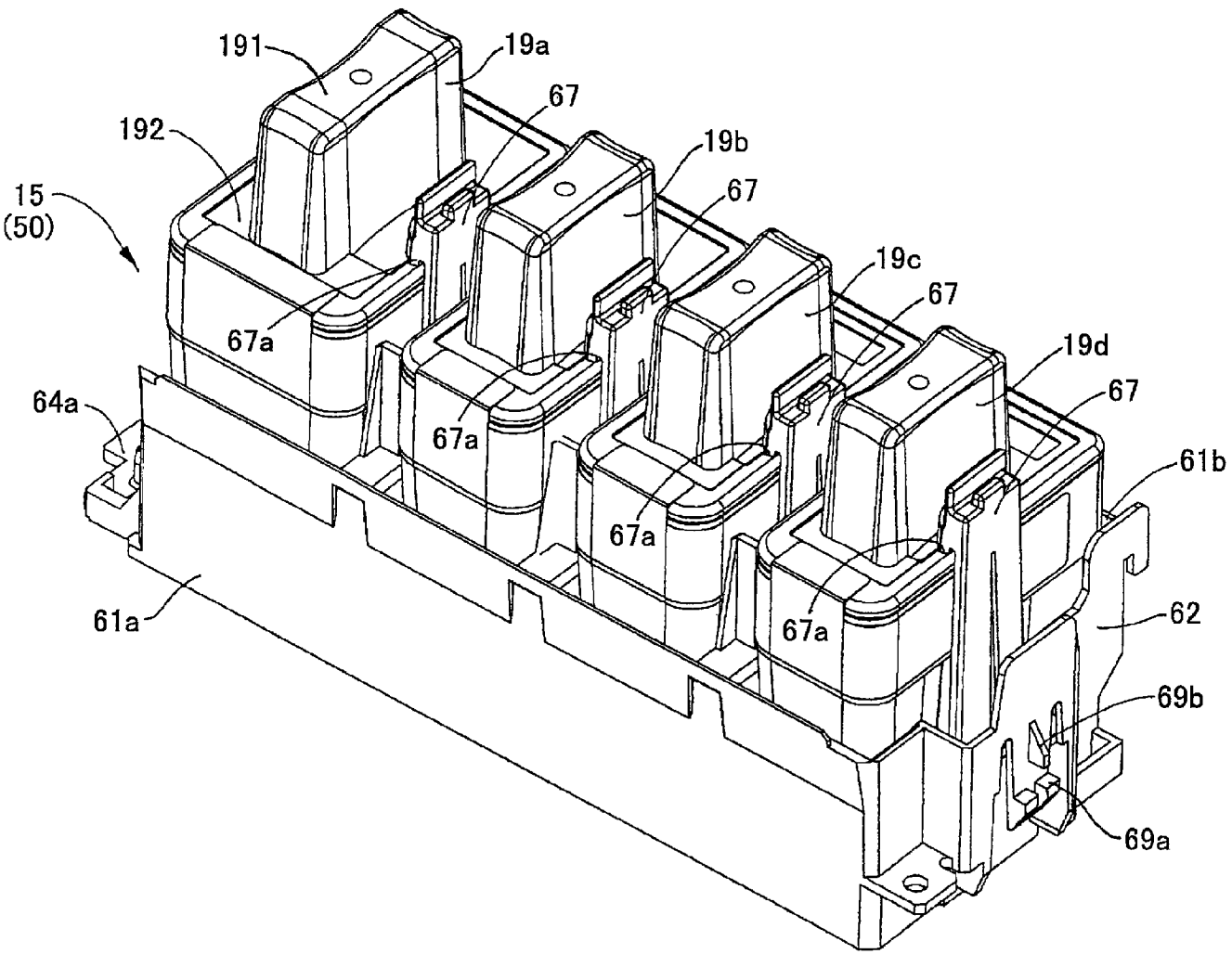
FIG. 6 is an enlarged perspective view showing an ink accommodating section provided in the image forming device in FIG. 1.
Figure 7:
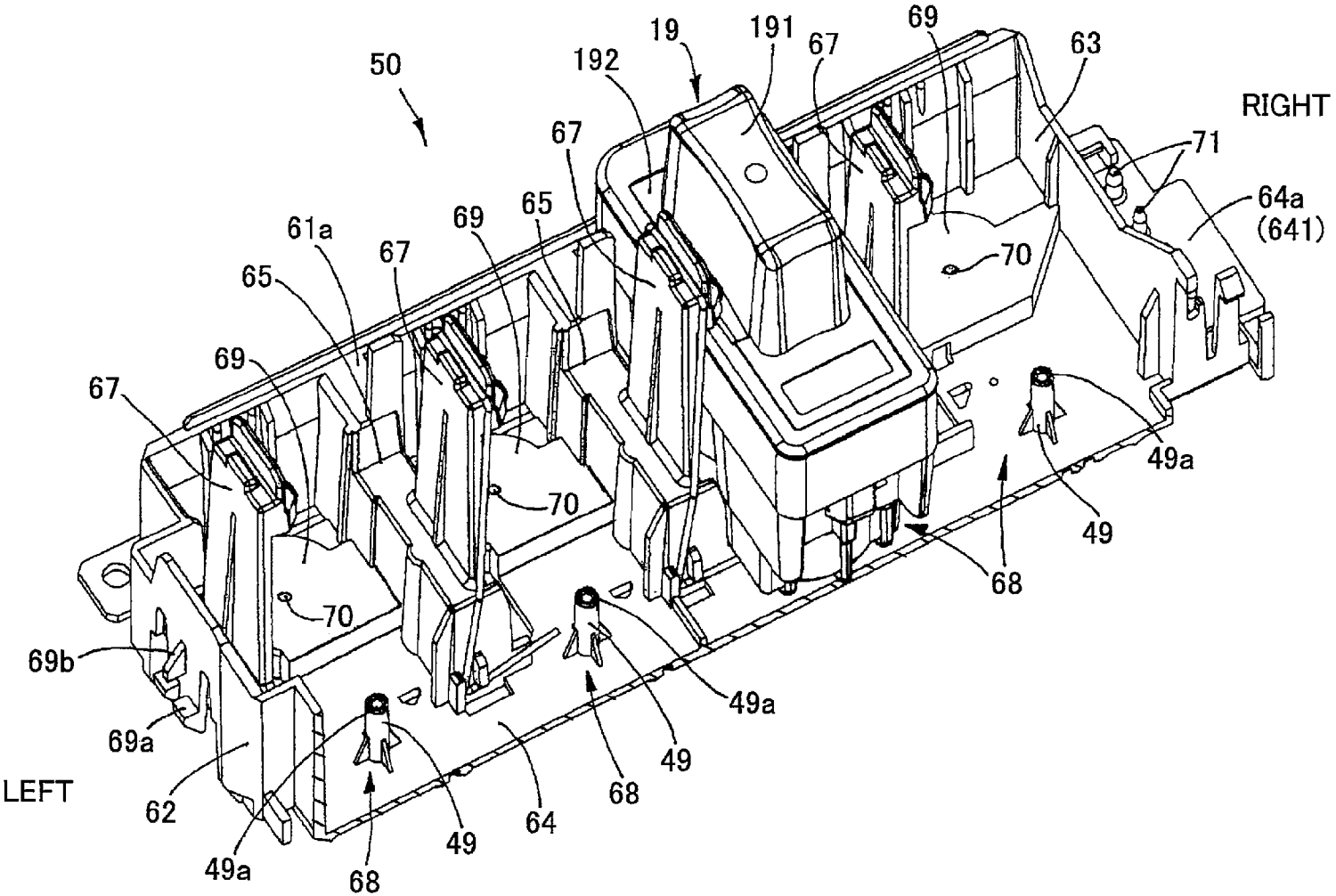
FIG. 7 is a perspective view showing a holder in accordance with a first illustrative example.
Figure 8:
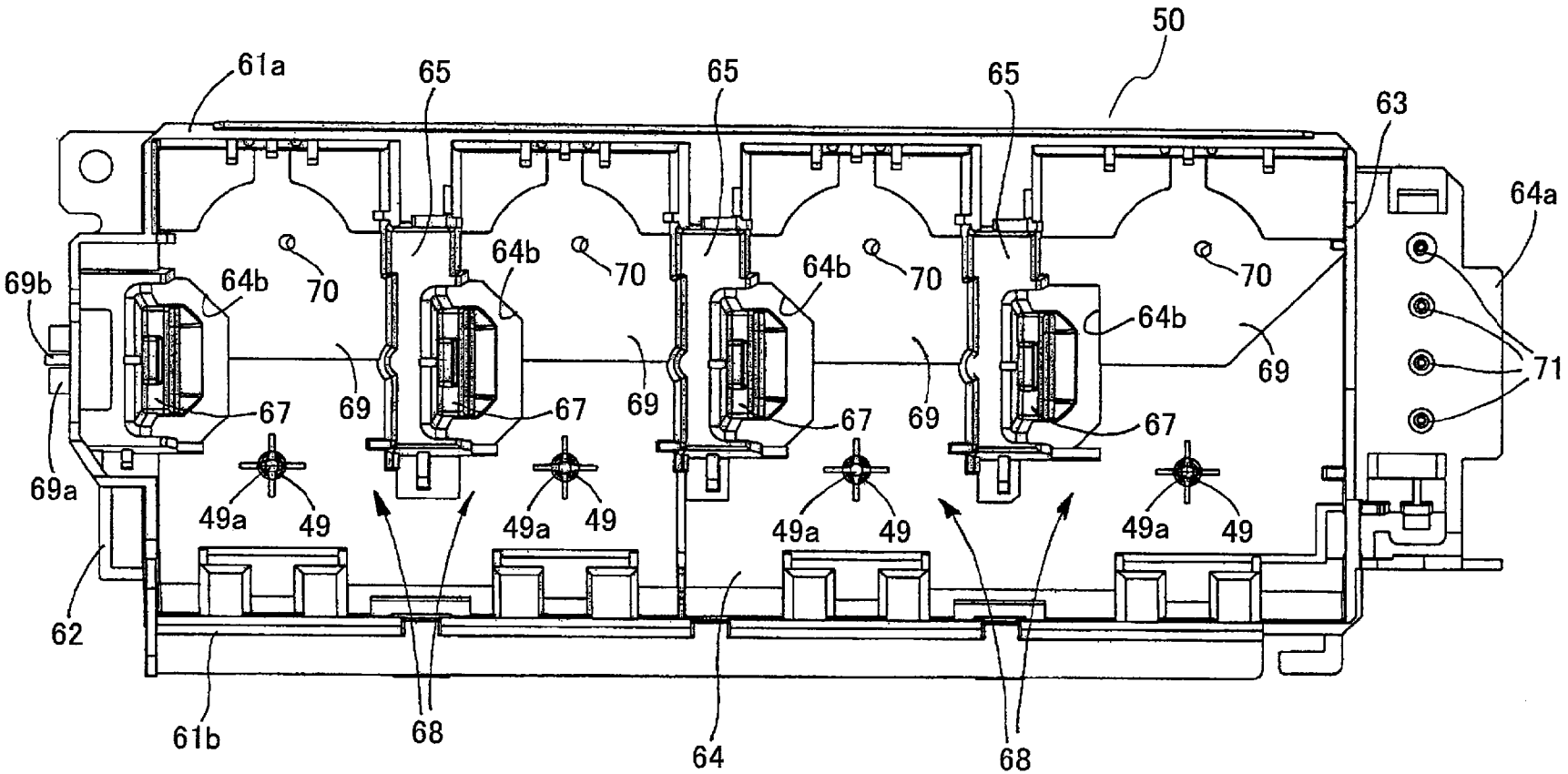
FIG. 8 is a plan view showing the holder in accordance with the first illustrative example.

Next, the holder 50 on which the ink cartridge 19 is mounted will be described. The holder 50 is an injection molded product made from a synthetic resin. As shown in FIG. 8, the holder 50 includes a rectangular bottom wall 64, a pair of long-side upstanding walls 61*a* and 61*b*, and a pair of short-side upstanding walls 62 and 63 orthogonal to the long-side upstanding walls 61*a* and 61*b*, thereby forming a box-shaped structure with an open top. The holder 50 further includes three partition walls 65 disposed in spaced-apart relation with one another and in parallel with the short-side upstanding walls 62 and 63. The bottom wall, long-side and short-side upstanding walls, and partition walls are formed integrally to configure the holder 50. As shown in FIGS. 6 and 7, one of the short-side upstanding walls 62 is formed with a locking rib 69*a* for fixing the holder 50 to the housing 2, and a guide part 69*b* for bringing the locking rib 69*b* into engagement with a rib receiving part (not shown) formed in the housing 2.

As shown in FIGS. 7 and 8, the bottom wall 64 of the holder 50 protrudes outwardly beyond the right-side upstanding wall 63 to form an extension 64*a*. An insertion portion 641 for insertion into a relevant part of the housing 2 is integrally formed at the rightmost portion of the extension 64*a*. Four connection tubes 71 with open faces oriented upward are formed on the extension 64*a* to allow the four ink supply tubes 40 to be connected in one-to-one correspondence.

As shown in FIGS. 7 and 8, the three partition walls 65 divide the internal space of the holder 5 into four cartridge accommodating chambers 68. In the illustrative example, as shown in FIG. 8, the cartridge accommodating chambers 68 except the rightmost one have substantially the same width in the lengthwise direction of the holder 50. The rightmost cartridge accommodating chamber 68 has a width slightly wider than that of each of the remaining three accommodating chambers 68. A black ink cartridge 19*a* containing a larger amount of ink than the other ink cartridges 19*b*, 19*c*, and 19*d* is accommodated in the rightmost cartridge accommodating chamber 68.

A plate-shaped ink absorbing member 74*b* is placed on the upper surface of the bottom wall 64 to cover all the ink cartridge accommodating chambers 68. The ink absorbing member 74*b* is provided separately from the ink absorbing member 74*a* provided outside the holder 50. The ink absorbing member 74*b* is provided for absorbing ink leaked out from the ink outflow port 46 of the ink tank 41 and ink oozed out from the ink absorbing member 74*a*.

A resiliently deformable locking arm 67 is integrally provided to each of the leftside upstanding wall 62 and the partition walls 65. As shown in FIGS. 6 and 7, the locking arms 67 extend upward from the top surfaces of the leftside upstanding wall 62 and the partition walls 65. A locking pawl 67*a* is integrally formed on the tip end of the locking arm 67. The locking pawl 67*a* engages the stepped portion 192 formed in the upper surface of the ink cartridge 19 from which a grasping portion 191 extends upward. The locking pawl 67*a* is provided for preventing the ink cartridge 19 from being dismounted from the holder 50. A recess is formed in the top surface of the stepped portion 192 so that the locking pawl 67*a* is clicked when engaged with or disengaged from the recess.

A through-hole 64*b* is formed on the bottom wall 64 of the holder 50 beneath each of the locking pawls 67*a*. The through-hole 64*b* has such a configuration that encompasses the outer profile of the locking pawl 67*a* projected onto the bottom wall 64. The through-hole 64*b* is formed to function as a draft for the locking pawl 67*a* molded using metal molds when a mold-unclamping operation is performed. As will be described later, the through-hole 64*b* is not completely closed when the ink cartridge 19 is mounted on the holder 50, so is utilized as an atmosphere communication hole for communicating with atmosphere and introducing air into the ink cartridge 19.

As shown in FIG. 10, each of the cartridge accommodating chambers 68 includes a seat 69 stepped up from the bottom wall 64 and disposed in a position facing the air tower 52. An air introducing port 70 is formed at the center of the seat 69. As shown in FIGS. 8 and 10, the seat 69 is positioned adjacent to the through-hole 64*b*. The upper portion of the air introducing port 70 is slightly larger in an inner diameter than the lower portion of the air introducing port 70, and a stepped portion is formed in the air introducing port 70, against which the lower end of the second valve 55 abuts. When the ink cartridge 19 is mounted on the cartridge accommodating chamber 68 while directing it in a correct orientation, the second valve 55 is brought into abutment with the stepped portion formed in the air introducing port 70 and is held in an elevated position, causing the air inflow port 56, which has been closed by the second valve 55, to open.

Figure 9:
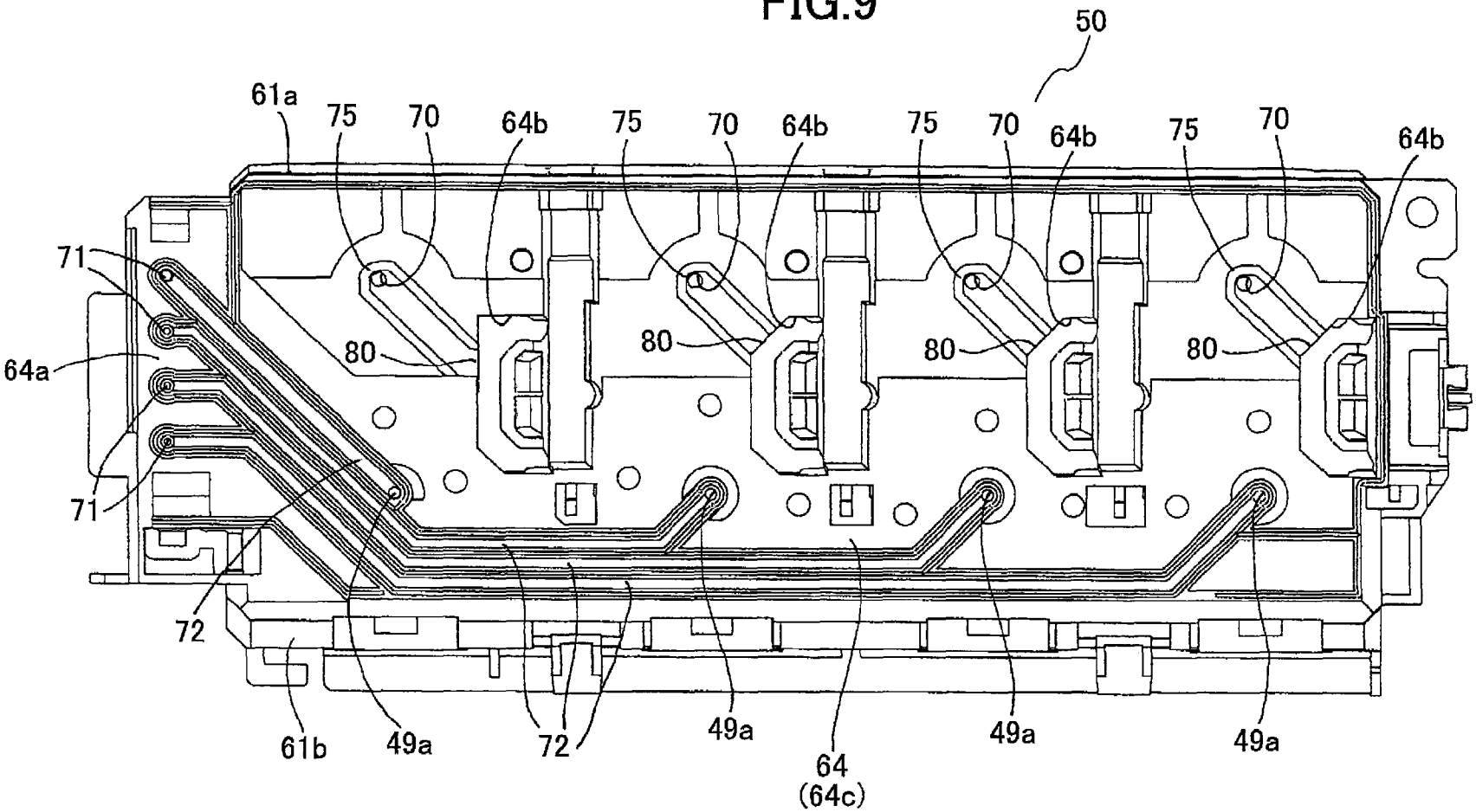
FIG. 9 is a bottom view showing the holder in accordance with the first illustrative example, from which an ink absorbing member and a filter are removed.
Figure 11:
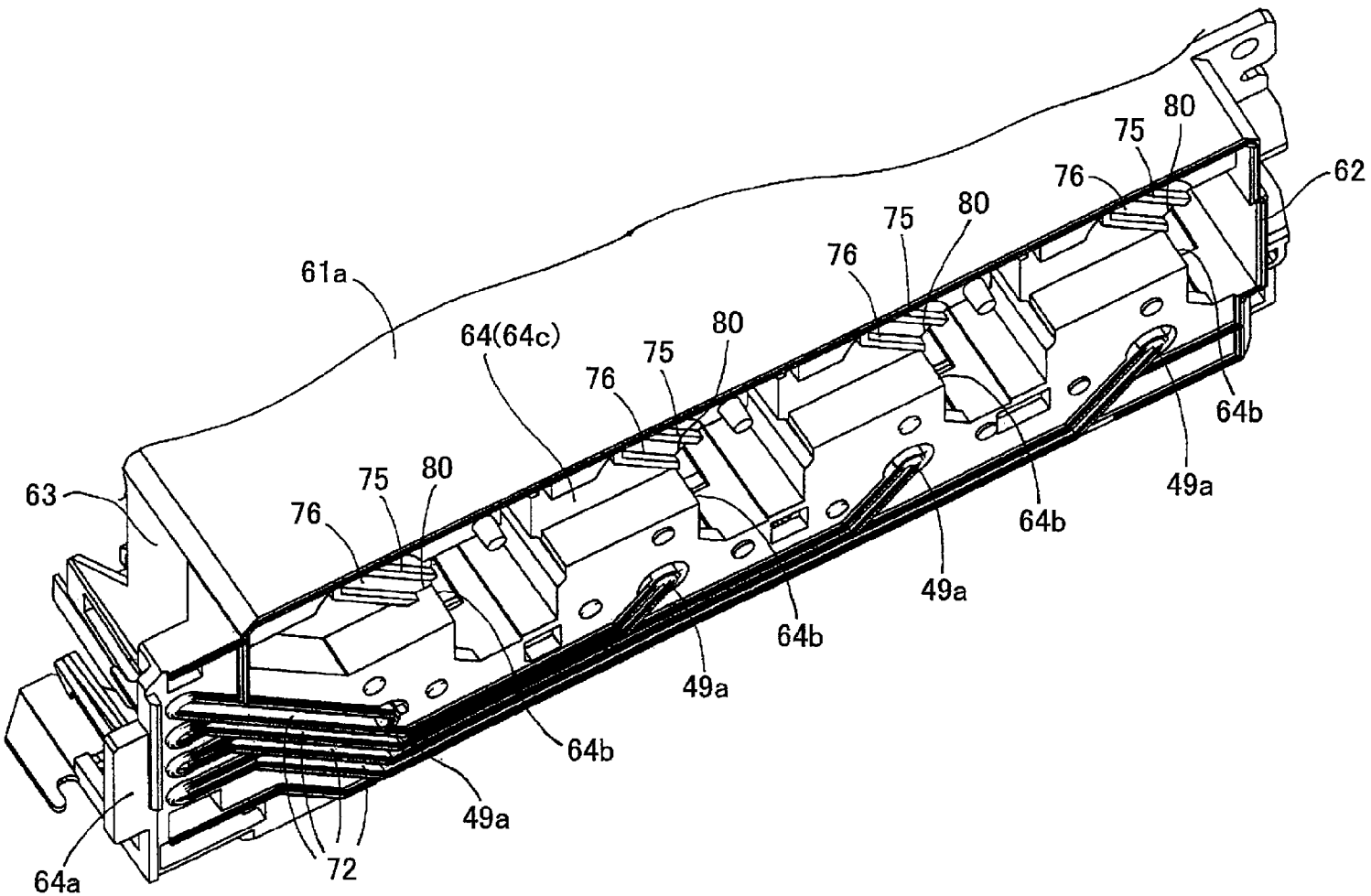
FIG. 11 is a perspective view showing the holder in accordance with the first illustrative example, as viewed from the bottom side thereof.
Figure 12:
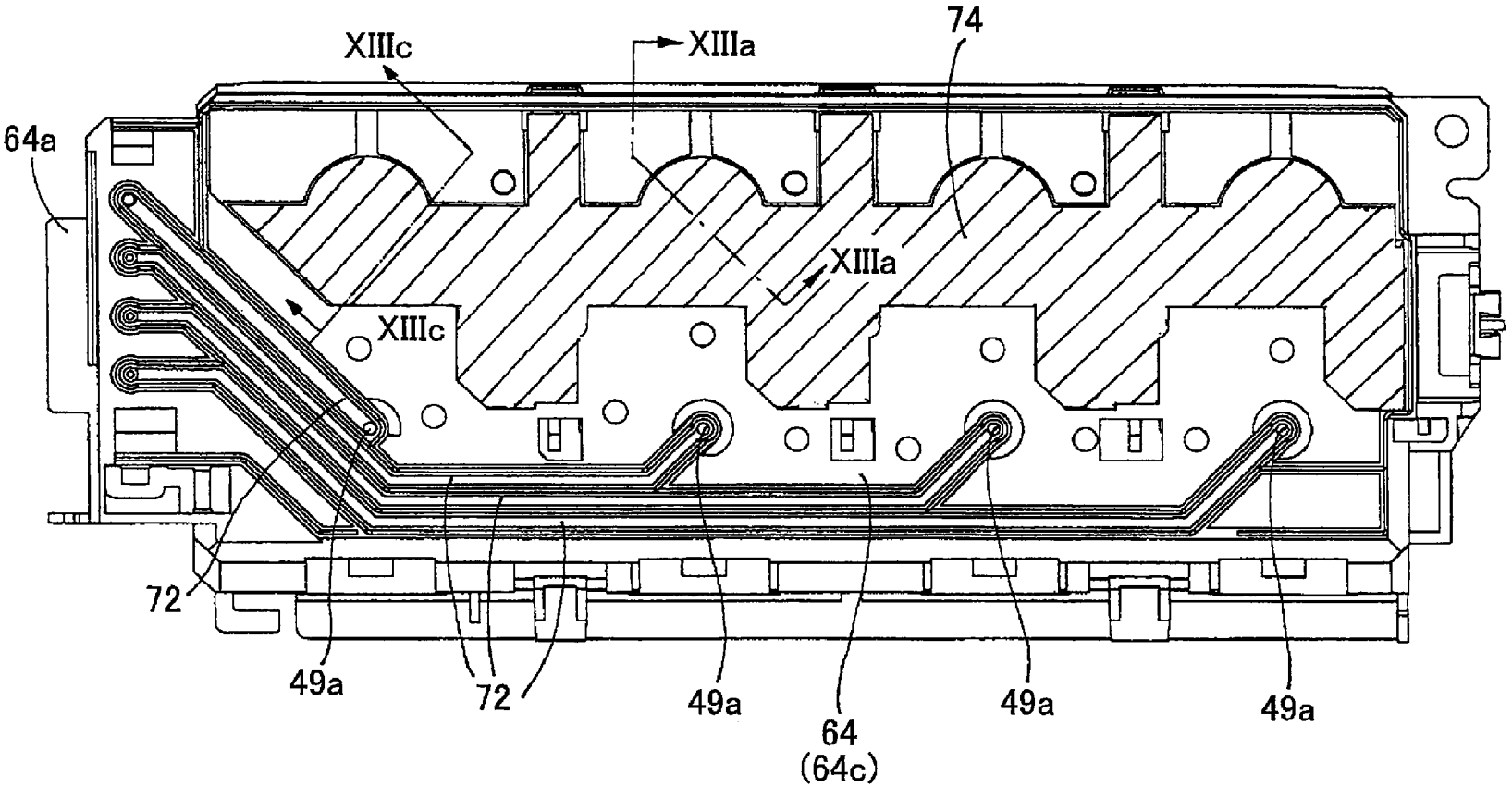
FIG. 12 is a bottom view showing the holder in accordance with the first illustrative example, from which the filter is removed.

As shown in FIGS. 9, 11 and 12, the bottom wall 64 of the holder 50 is integrally formed with the ink discharge member 49 in a position confronting the ink outflow port 46 of each cartridge accommodating chamber 68. The ink discharge member 49 is substantially in a cylindrical shape and is protruded upward from the bottom wall 64 of the holder 50. The ink discharge member 49 is internally formed with an ink pathway serving as an ink discharge port 49*a* which vertically passes through the ink discharge member 49. The distal end portion of the ink discharge member 49 has an outer diameter slightly larger than the inner diameter of the ink outflow port 46. As shown in FIG. 10, the lower aperture periphery of the ink outflow port 64 is tapered to facilitate insertion of the distal tip portion of the ink discharge member 49 into the ink outflow port 64. To insert the ink discharge member 49 into the ink outflow port 64, the distal end portion of the ink discharge member 49 is inserted into the center hole of the ink packing 44 so as to be force-fitted thereto.

Figure 13A:
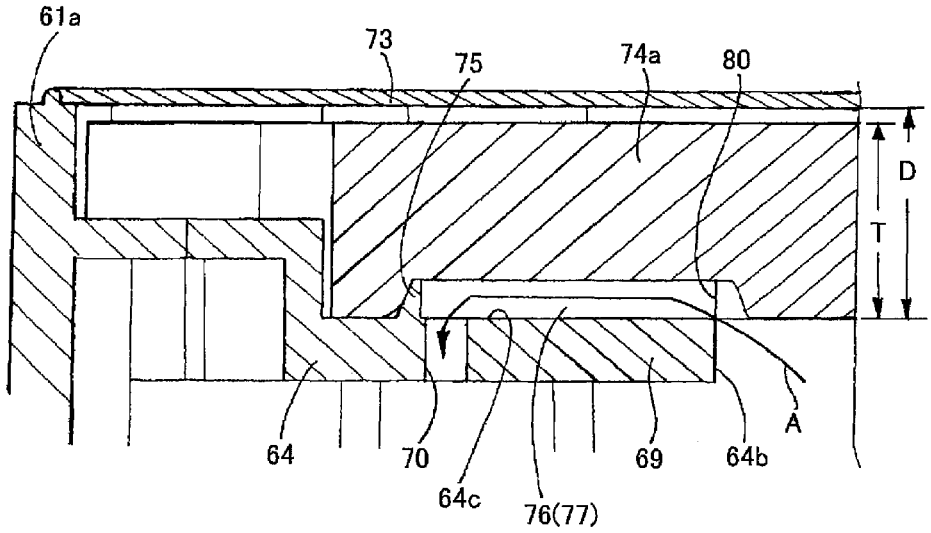
FIG. 13A is a cross-sectional view showing the holder in accordance with the first illustrative example, taken along a line XIIIa-XIIIa in FIG. 12.
Figure 13B:
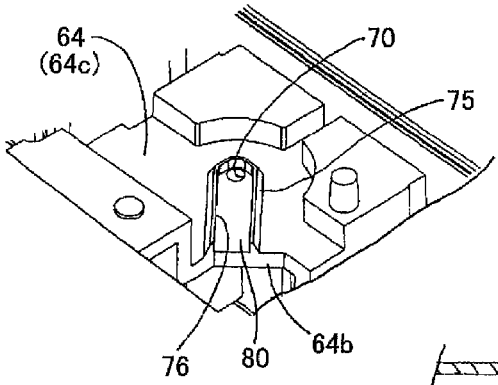
FIG. 13B is a perspective view showing a part of the holder in accordance with the first illustrative example, from which the ink absorbing member and the filter are removed.

As shown in FIGS. 9, 11, and 12, the lower surface of the holder's bottom wall 64 is formed with four ink channels 72 for connecting the four ink discharge ports 49*a* to the four connection tubes 71 formed in the extension 64*a*, respectively, so that ink stored in the respective ink cartridges 19 can be supplied to the corresponding ink supply tubes 20. As shown in FIGS. 10, 13A and 13B, each of the ink channels 72 is formed in such a manner that the lower surface of the bottom wall 64 is engraved to form a groove therein and an ink non-permeable film 73 is hermetically affixed to cover the groove. As will be described later, the lower surface 64*c* of the bottom wall 64 is formed with a closed space with an atmosphere communication hole.

As shown in FIGS. 12, 13A and 13B, the ink absorbing member 74*a* is interposed between the lower surface 64*c* of the bottom wall 64 and the film 73. The ink absorbing member 74*a* extends to four ink absorbing member accommodating rooms formed below the seats 69 that are upwardly protruded from the bottom wall 64, and is configured to cover both the ceiling walls of the four rooms and the four through-holes 64*b* formed in the bottom wall 64. In FIG. 12, the ink absorbing member 74*a* is depicted by oblique lines for the purpose of emphasis.

As shown in FIG. 13A, the thickness T of the ink absorbing member 74*a* is set to be slightly thinner than the gap dimension D between the film 73 and the lower surface 64*c* of the bottom wall 64, that is, the ceiling wall surface of the room formed below the seat 69. It is to be noted that FIG. 13B is depicted upside down, so that the ceiling wall of the room appears above the bottom wall 64. The thickness T can be the same as the gap dimension D. The ink absorbing member 74*a* has an ink absorbing capability and is formed from a resiliently deformable material, such as a porous foam resin, felt, or sponge.

As shown in FIGS. 9, 11 and 13A through 13C, a protrusion 75 is formed downwardly from the bottom wall 64 of the holder 50. In this illustrative example, the protrusion 75 is a continuous, rib-like shape having a generally U-shaped cross-section. The air introducing port 70 is formed in the inner side of the U-shaped protrusion 75. A U-shaped opening 80 is in confrontation with the through-hole 64*b* formed in the bottom wall 64.

When the ink absorbing member 74*a* with a thickness T is placed in the room formed below the seat 69, the resiliently deformable ink absorbing member 74*a* is deformed by compression due to abutment with the protrusion 75. However, the ink absorbing member 74*a* is basically solid in nature and has a shape maintenance property. Accordingly, as shown in FIGS. 13A and 13B, a gap 77 is formed between the lower surface 64*c* of the bottom wall 64 and the ink absorbing member 74*a* within the inner side of the U-shaped protrusion 75. It is to be noted that both FIGS. 13A and 13B are depicted upside down.

On the other hand, the through-hole 64*b* in fluid communication with the U-shaped opening 80 is open to atmosphere at the upper surface of the bottom wall 64. As such, the through-hole 64*b* serves as the atmosphere communication hole, and the gap 77 formed in the inner side of the U-shaped protrusion 75 as an atmosphere communication channel 76 for introducing air into the air introducing port 70. The provision of the atmosphere communication channel 76 does not weaken an ink absorbing capability of the ink absorbing member 74*a* as the ink absorbing member 74*a* extends from the air introducing port 70 to the atmosphere communication hole (through-hole) 64*b*.

Figure 13C:
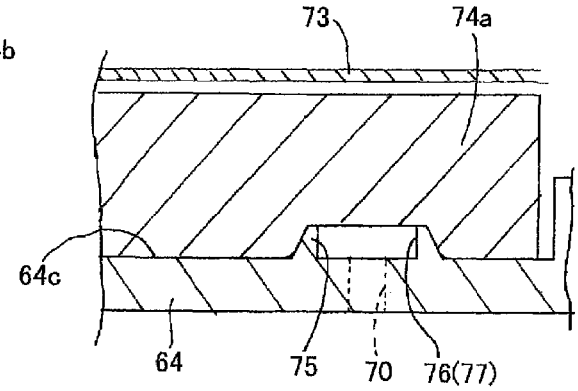
FIG. 13C is a cross-sectional view showing the holder in accordance with the first illustrative example, taken along a line XIIIc-XIIIc in FIG. 12.

It is to be noted that FIG. 10 omits illustration of the protrusion 75 and the atmosphere communication channel 76. As shown in FIGS. 13B and 13C, the outer surface of the protrusion 75 is gradually inwardly slanted to have a reduced cross-section toward the distal end of the protrusion 75. With such a shape of the protrusion 75, the ink absorbing member 74*a* can easily conform to the outer surface of the U-shaped protrusion 75. However, the shape of the protrusion 75 is not limited to the one as illustrated but can be shaped to have, for example, a rectangular cross-section.

As described, the ink absorbing member 74*a* is disposed in the lower surface side of the bottom wall 64 of the holder 50 in a position to confront the air introducing port 70 of the ink cartridge 19. The air introducing port 70 is in fluid communication with the atmosphere communication hole (through-hole 64*b*). With this structure, the ink absorbing member 74*a* absorbs ink entered into the air tower 52 and leaked out from the bottom wall 64 through the air inflow port 56 and air introducing port 70. Thus, ink leakage out from the printer is prevented, and so articles around the printer are not stained with ink. Even if the image forming device 1 with the ink cartridges 19 is transported while not maintaining the correct posture and the top opening 52*a* of the air tower 52 is immersed in the ink, ink stain is not a matter of concern, allowing transportation of the image forming device 1 to be easily carried out.

With the above-described structure, although the air introducing port 70 faces the ink absorbing member 74*a*, the atmosphere communication channel 76 is preserved so as to be in communication with the air introducing port 70. Accordingly, the air introducing port 70 is not closed by the ink absorbing member 74*a*, so that introduction of air into the air introducing port 70 and the ink tank 41 is assured as indicated by arrow A in FIG. 13A. As a result, when the image forming device 1 is in operation, a desirable ink ejection can be performed while eliminating a pressure difference between the interior and exterior of the ink cartridge 19.

Next, another illustrative example of the air communication channels 76 will be described, which affords similar advantages to those described above.

Figure 14A:
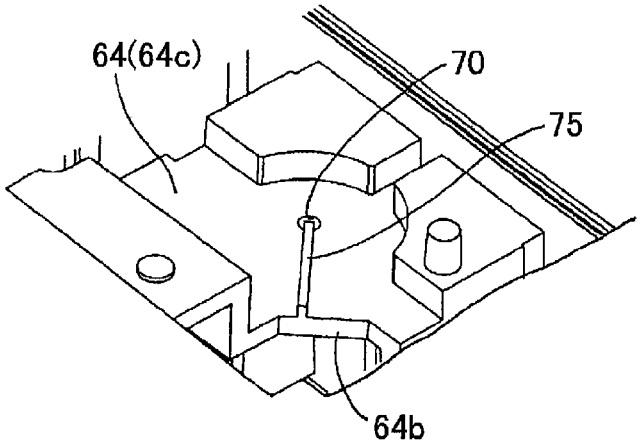
FIG. 14A is a perspective view showing a part of the holder in accordance with a second illustrative example, from which the ink absorbing member and the filter are removed.
Figure 14B:
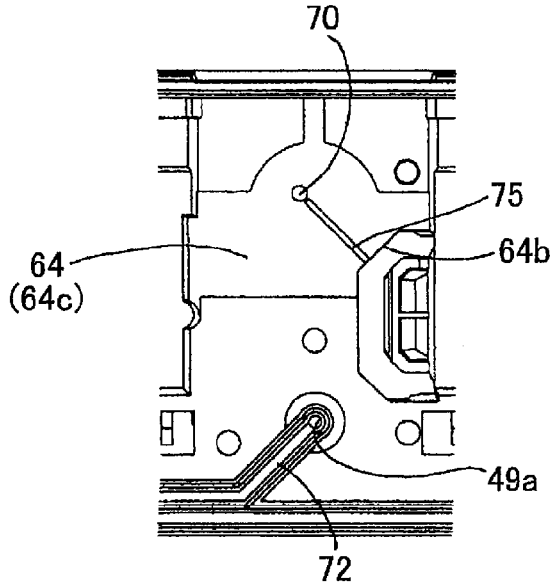
FIG. 14B is a bottom view showing the holder in accordance with the second illustrative example, from which an ink absorbing member and a filter are removed.
Figure 14C:
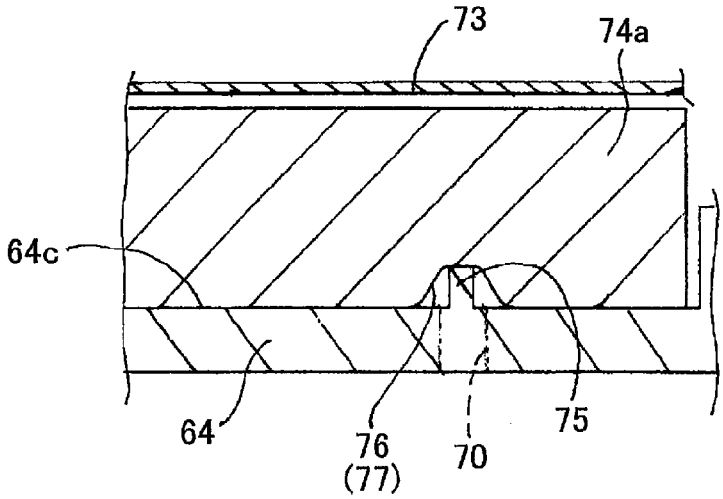
FIG. 14C is a cross-sectional view showing the holder in accordance with the second illustrative example, taken along a line corresponding to the line XIIIc-XIIIc in FIG. 12.

In the illustrative example shown in FIGS. 14A through 14C, the protrusion 75 is in the form of a linearly extending rib formed along a line connecting the air introducing port 70 and the opening 64*b*. The protrusion 75 has a generally rectangular cross-section orthogonal to the longitudinal direction of the protrusion 75. When the ink absorbing member 74*a* is compressed and deformed by the contact with the protrusion 75, the ink absorbing member 74*a* does not conform with the shape of the protrusion 75 due to the shape maintenance property of the ink absorbing member 74*a*. A gap 77 is formed around the protrusion 75 and along the longitudinal direction of the protrusion 75. The gap 77 forms the atmosphere communication channel 76 for connecting the air introduction port 70 to the through-hole 64*b*.

Figure 15A:
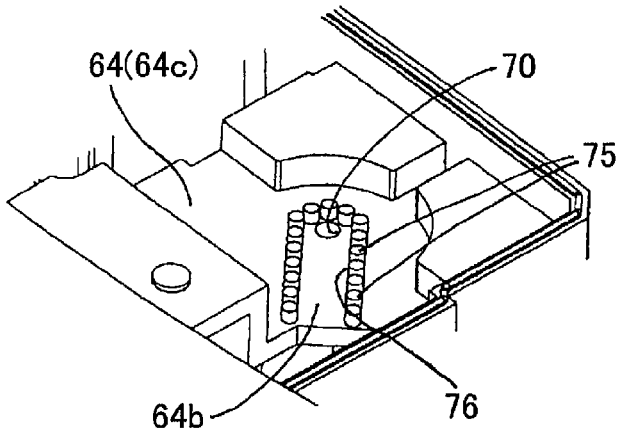
FIG. 15A is a perspective view showing a part of the holder in accordance with a third illustrative example, from which the ink absorbing member and the filter are removed.
Figure 15B:
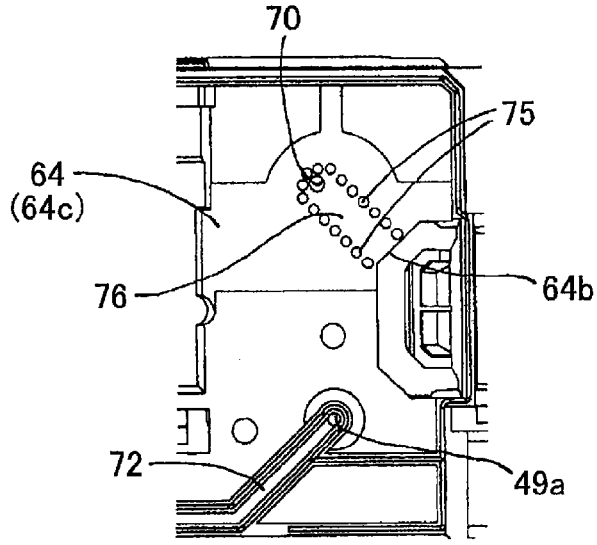
FIG. 15B is a bottom view showing the holder in accordance with the third illustrative example, from which an ink absorbing member and a filter are removed.
Figure 15C:
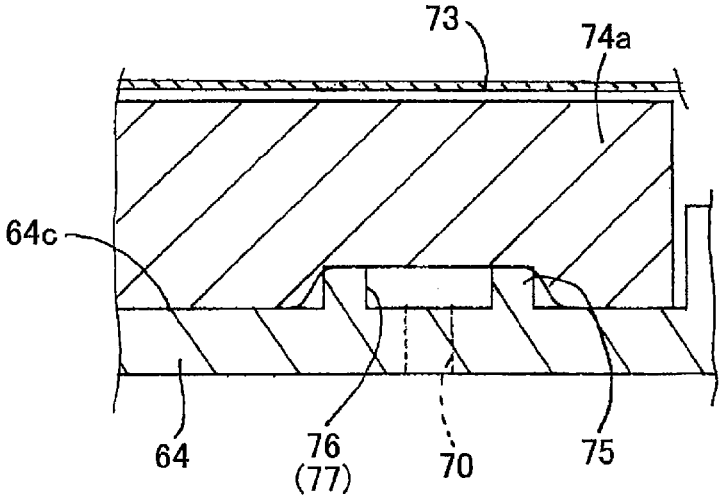
FIG. 15C is a cross-sectional view showing the holder in accordance with the third illustrative example, taken along a line corresponding to the line XIIIc-XIIIc in FIG. 12.

FIGS. 15A through 15C show still another illustrative example in which the protrusion 75 is configured by a plurality of cylindrically shaped pieces. These cylindrical protrusions are arranged to be generally U-shaped in plan view similar to the shape shown in FIGS. 9 and 13B. With this structure, the inner gap 77 surrounded by the cylindrical protrusions serves as the atmosphere communication channel 76.

Figure 16A:
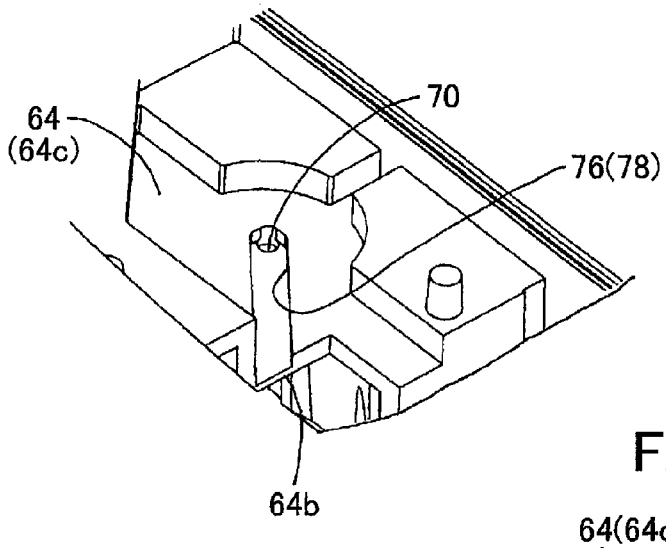
FIG. 16A is a perspective view showing a part of the holder in accordance with a fourth illustrative example, from which the ink absorbing member and the filter are removed.
Figure 16B:
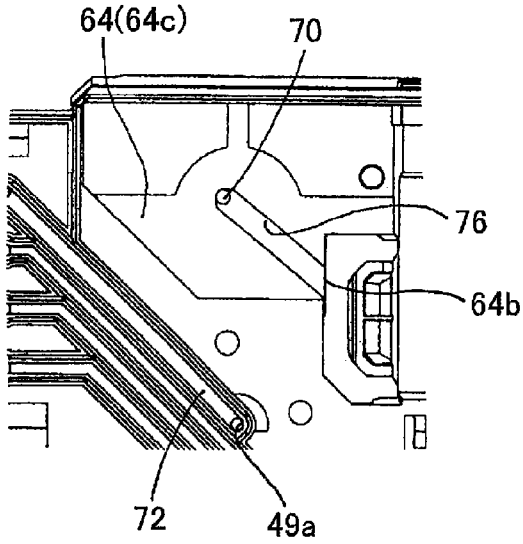
FIG. 16B is a bottom view showing the holder in accordance with the fourth illustrative example, from which an ink absorbing member and a filter are removed.
Figure 16C:
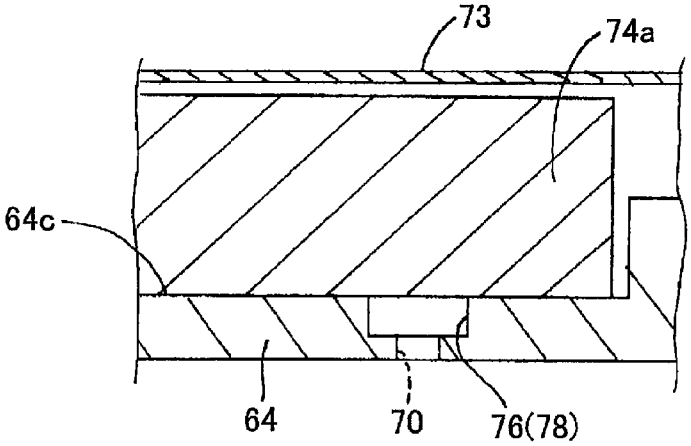
FIG. 16C is a cross-sectional view showing the holder in accordance with the fourth illustrative example, taken along a line corresponding to the line XIIIc-XIIIc in FIG. 12.

FIGS. 16A through 16C show yet another illustrative example in which the protrusion 75 is not formed in the lower surface 64*c* of the bottom wall 64 but a recess 78 open to the side of the ink absorbing member 74*a* is formed. Accordingly, when the ink absorbing member 74*a* with a thickness T as shown in FIG. 13A is disposed in the lower surface side of the bottom wall 74*a*, a gap that forms the air communication channel 76 is formed between the lower surface 64*c* of the bottom wall 64 and the ink absorbing member 74*a*. In this case, the ink absorbing member 74*a* is not deformed as in the previously described illustrative examples.

Figure 17A:
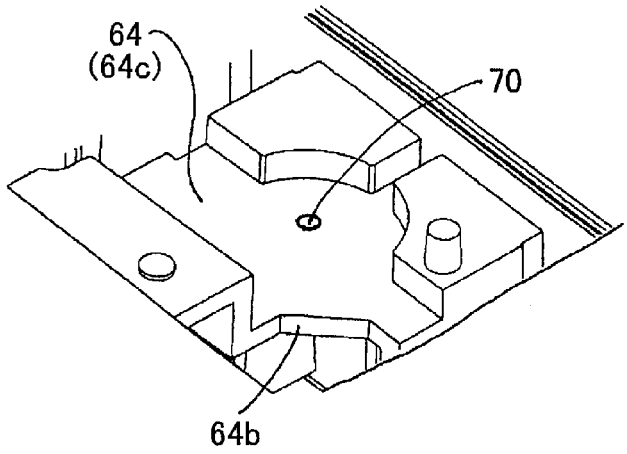
FIG. 17A is a perspective view showing a part of the holder in accordance with a fifth illustrative example, from which the ink absorbing member and the filter are removed.
Figure 17B:
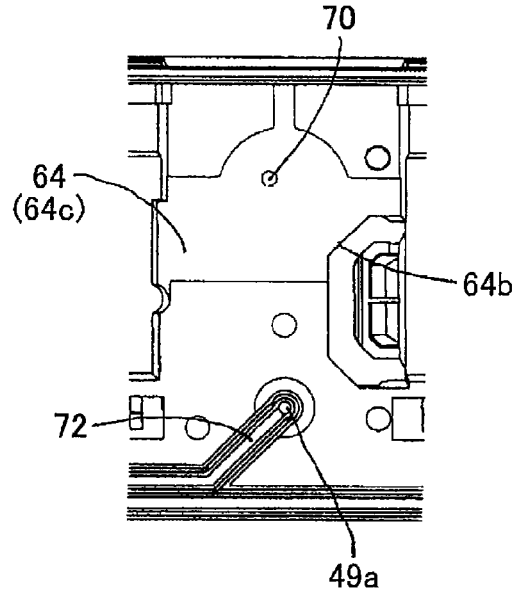
FIG. 17B is a bottom view showing the holder in accordance with the fifth illustrative example, from which an ink absorbing member and a filter are removed.
Figure 17C:
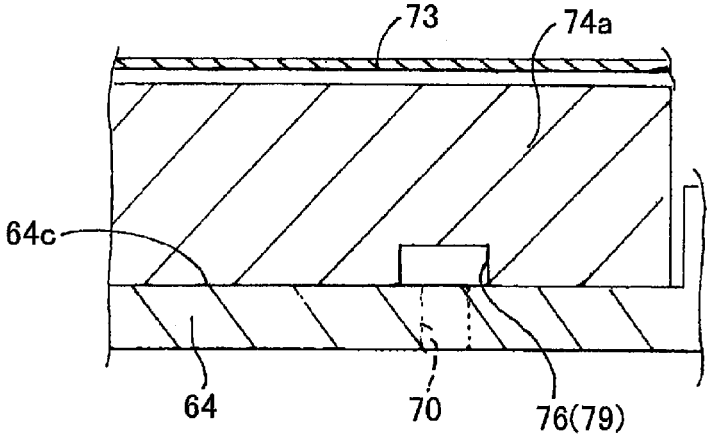
FIG. 17C is a cross-sectional view showing the holder in accordance with the fifth illustrative example, taken along a line corresponding to the line XIIIc-XIIIc in FIG. 12.

FIGS. 17A through 17C shows further illustrative example in which the protrusion 75 is not formed in the lower surface 64*c* of the bottom wall 64 but a recess 79 is formed in the upper surface of the ink absorbing member 74*a*. The recess 79 opens toward the bottom wall 74*a* and is used as the atmosphere communication channel 76. Accordingly, with no deformation of the ink absorbing member 74*a*, a gap that forms the atmosphere communication channel 76 is formed between the lower surface 64*c* of the bottom wall 64 and the ink absorbing member 74*a*.

Although the invention has been described with respect to specific illustrative examples, it will be appreciated by one skilled in the art that a variety of changes may be made without departing from the scope of the invention.

What is claimed is:

1. An image forming device comprising:

a recording head that forms images with ink;

an ink cartridge including an ink tank in which ink is stored, the ink cartridge having a wall formed with an ink outflow port from which ink in the ink tank is discharged and an air inflow port that brings an internal space of the ink tank in communication with atmosphere;

a holder having a wall on which the ink cartridge is detachably mounted;

an ink supply tube that is connected to the holder and supplies ink discharged from the ink tank via the ink outflow port to the recording head while air is introduced into the ink tank via the air inflow port for an amount corresponding to an amount of ink supplied to the recording head;

an ink absorbing member; and an accommodating section disposed in a position opposed to the ink cartridge with the wall of the holder interposed therebetween and having an inner space in which the ink absorbing member is accommodated, the accommodating section being formed with an atmosphere communication hole in communication with atmosphere, wherein the ink absorbing member disposed within the accommodating section is opposed to the air inflow port.

2. The image forming device according to claim 1, further comprising another ink absorbing member interposed between the wall of the ink cartridge and the wall of the holder and in a position adjacent the ink outflow port.

3. The image forming device according to claim 1, wherein the holder is of an open structure having an opening and allowing the ink cartridge to be mounted on or detached from the holder through the opening.

4. The image forming device according to claim 1, wherein the wall of the holder is formed with an ink discharge port connected to the ink outflow port and an air introducing port connected to the air inflow port.

5. The image forming device according to claim 4, wherein an atmosphere communication channel is provided in the inner space of the accommodating section, the atmosphere communication channel being in communication with the atmosphere communication hole and fluidly connected to the air introducing port.

6. The image forming device according to claim 5, wherein the atmosphere communication hole is formed in the wall of the holder.

7. The image forming device according to claim 6, wherein the wall of the holder has s surface that is opposite from the ink cartridge and formed with at least one protrusion protruding toward the ink absorbing member, the protrusion serving as the atmosphere communication channel.

8. The image forming device according to claim 7, wherein the ink absorbing member is made from a resiliently deformable material, the ink absorbing member being deformed to provide a gap forming a part of the atmosphere communication channel when the protrusion is in abutment with the ink absorbing member.

9. The image forming device according to claim 7, wherein the protrusion comprises a wall having a generally U-shaped cross-section, an inner space of the protrusion serving as the atmosphere communication channel.

10. The image forming device according to claim 9, wherein the air introducing port is in communication with the inner space of the protrusion, and the inner space of the protrusion is in communication with the atmosphere communication hole.

11. The image forming device according to claim 7, wherein the protrusion has a linearly elongated shape and is arranged on a line connecting the air introducing port and the atmosphere communication hole.

12. The image forming device according to claim 5, wherein the atmosphere communication channel is open to a side of the wall of the holder opposite from the ink cartridge.

13. The image forming device according to claim 5, wherein the wall of the holder is formed with a recess on a surface opposite from the ink cartridge, the recess serving as the atmosphere communication channel.

14. The image forming device according to claim 5, wherein the ink absorbing member has a surface that is opposed to the ink cartridge with the wall of the holder interposed therebetween and formed with a recess serving as the atmosphere communication channel.

15. The image forming device according to claim 5, wherein the atmosphere communication channel is open toward the ink absorbing member.

16. The image forming device according to claim 1, further comprising a housing having a wall on which the holder is placed, wherein the accommodating section is defined by the wall of the holder and the wall of the housing, wherein the wall defining the accommodating section is stepped up with respect to a remaining part of the wall of the holder.

* * * * *